US006869252B1

(12) United States Patent
Maini et al.

(10) Patent No.: US 6,869,252 B1
(45) Date of Patent: Mar. 22, 2005

(54) TAUT MOORING SYSTEM FOR JACK-UP TYPE MOBILE OFFSHORE PLATFORMS

(75) Inventors: Ramesh Maini, Houston, TX (US); Partha Chakrabarti, Katy, TX (US); John S. Laird, II, Cypress, TX (US); Kenneth P. Choate, Houston, TX (US)

(73) Assignee: Zentech, Inc., Houston, TX (US)

( * ) Notice: Subject to any disclaimer, the term of this patent is extended or adjusted under 35 U.S.C. 154(b) by 0 days.

(21) Appl. No.: 09/473,323

(22) Filed: Dec. 28, 1999

(51) Int. Cl.[7] ..... B63B 21/50

(52) U.S. Cl. ..... 405/224; 405/199; 405/198; 405/196

(58) Field of Search ..... 405/196, 197, 405/198, 199, 200, 224, 203, 204, 205, 208, 224.1, 224.4

(56) References Cited

U.S. PATENT DOCUMENTS

| | | | | | |
|---|---|---|---|---|---|
| 2,987,892 | A | * | 6/1961 | Reeve | 405/200 |
| 2,988,893 | A | * | 6/1961 | Borrmann et al. | 405/226 |
| 3,294,051 | A | * | 12/1966 | Khelstovsky | 405/200 |
| 3,433,024 | A | * | 3/1969 | Diamond et al. | 405/196 |
| 3,515,084 | A | | 6/1970 | Holmes | |
| 3,605,669 | A | * | 9/1971 | Yu | 405/200 |
| 4,329,088 | A | * | 5/1982 | Lucas | 405/196 |
| 4,378,178 | A | | 3/1983 | Roach | |
| 4,432,671 | A | * | 2/1984 | Westra et al. | 405/226 |
| 4,471,709 | A | * | 9/1984 | Chun | 114/293 |
| 4,640,647 | A | | 2/1987 | Blair et al. | |
| 4,702,321 | A | * | 10/1987 | Horton | 405/205 |
| 4,710,061 | A | | 12/1987 | Blair et al. | |
| 4,735,526 | A | * | 4/1988 | Kawagoe et al. | 405/196 |
| 4,797,033 | A | | 1/1989 | Pollack | |
| 4,818,146 | A | | 4/1989 | Fontenot et al. | |
| 4,938,630 | A | * | 7/1990 | Karsan et al. | 405/224 |
| 5,061,131 | A | | 10/1991 | Petty et al. | |
| 5,147,148 | A | * | 9/1992 | White et al. | 405/199 |
| 5,222,453 | A | * | 6/1993 | Chabot | 114/293 |
| 5,498,107 | A | * | 3/1996 | Schatzle, Jr. | 405/224 |
| 5,906,457 | A | | 5/1999 | Choate et al. | |
| 6,113,315 | A | * | 9/2000 | Fulton et al. | 405/224.1 |

* cited by examiner

*Primary Examiner*—Frederick L. Lagman
(74) *Attorney, Agent, or Firm*—Baker & McKenzie LLP

(57) ABSTRACT

A taut mooring system for use on a mobile offshore jack-up platform while it is in an elevated operating condition. The elevated operating condition is with the hull jacked up a safe distance above the highest anticipated wave crests, on vertically movable legs which extend to the ocean floor. The mooring system consists of: radially spaced mooring line attachment means on the structure of the platform; suction piles that are radially spaced around the platform, consistent with the radial spacing of the mooring line attachment means; and taut mooring lines which radially connect the suction piles to the attachment means. The flexibility of the taut mooring system provides the ability to coact with the platform's free standing storm resistance capabilities, yielding enhanced capabilities that will enable the platform to safely resist storm induced forces that the platform would not normally be capable of withstanding, and to enable the platform to be used with longer legs in deeper water.

45 Claims, 8 Drawing Sheets

TAUT MOORING SYSTEM FOR JACK-UP TYPE MOBILE OFFSHORE PLATFORMS

BACKGROUND AND FIELD OF THE INVENTION

Jack-ups have been used for oil or gas well drilling, work platforms, oil or gas production platforms, and many other uses. These jack-ups usually consist of a barge shaped hull, generally triangular in plan, supported by three or more trussed legs which usually extend vertically through openings in the hull at the "corners" of the triangle, or extremities of the hull. The trussed legs are usually fitted with vertically extending toothed gear racks on the chords of the legs and the hull is usually fitted with elevating gear units, commonly referred to as "jacks", that engage with the gear racks to raise and lower the legs when the jack-up is afloat and to raise and lower the hull when the legs have penetrated the ocean floor.

For normal operations, when putting a jack-up on an operating location, the legs are lowered to the ocean floor with the jacks, and jacking continues until soil resistance to penetration of the legs causes the hull to lift out of the water a few feet. Additional soil resistance is usually developed to simulate the largest reaction between the legs and the ocean floor that may be anticipated while at that location. This is normally done by pumping sea water into ballast compartments of the hull.

After developing this additional soil resistance, the hull is then elevated to the desired elevation, which is at least high enough to assure that the crest of the largest anticipated waves will be below the bottom of the hull.

While elevated in this operating position, jack-ups may be subjected to large forces from storm winds, waves and currents. These forces induce stresses in the hull and trussed leg members. Resistance to these storm induced stresses normally determines the strength requirements for the design of the leg members. Additionally, resistance to these storm forces usually determines the maximum leg footing reaction to the ocean floor, therefore it also determines the preload tank capacity requirements. These forces induce large interacting forces and moments between the hull and the legs of jack-ups. For jack-ups without leg-to-hull locking systems, resisting these interacting forces may control the design of the leg guide support structure and portions of the elevating gear units. For jack-ups with leg-to-hull locking systems, resisting these interacting forces usually controls the design of the leg-to-hull locking systems and their support structure on the hull.

The elevating gear units of a jack-up, commonly referred to as "jacks", are usually mounted in housings that are located radially out from the center of each leg chord and extend vertically up from a location above the top deck of the hull. The gear units are normally mounted one above the other in the housings. Usually there are two levels of leg guides which keep the legs relatively perpendicular to the hull bottom. With this arrangement, the jacks resist all vertical interaction forces between the hull and the legs, and the jacks work together with the leg guides to resist the storm induced moment between the hull and the legs. Some jack-ups have hull-to-leg locking systems, commonly referred to as "rack chocks", that are installed after the jack-up is elevated to the operating position. These locking systems are used to support the hull on the legs and resist the interacting forces between the hull and legs that are caused by the environmental forces.

U.S. Pat. No. 5,906,457, issued to the applicant, is illustrative.

Recently the exploration and production in deeper water locations has become increasingly important. Available existing jack-ups are often not suited to deeper water, or more sever conditions, or the combination of water depth and environmental criteria of the desired location. The large loads from storm winds, waves and currents, combined with longer leg lengths cause studies for using existing jack-ups to show that one or more of the above limiting design parameters is exceeded. The prior art solution has been to use floating rigs at greater cost.

U.S. Pat. No. 4,378,178 to Roach relates to a lightweight offshore platform structure for use at a plurality of successive sites which is adjustable in height to accommodate a range of water depths. A plurality of anchors spaced around the structure and attached to the ocean floor comprise an anchoring means and are joined to the structure via lower and upper guylines. The attachment of the lower guylines occurs below the water surface sufficiently deep so as to avoid interfering with boats and the like, whereas the upper guylines are adjustable attached the platform to stabilize the structure against storm conditions.

U.S. Pat. No. 3,515,084 to Holmes discloses a floatation unit which may be added to a conventional mat jack-up type platform to permit use of the drill platform in both shallow and deep water drilling operations. As shown in FIG. 2, the entire apparatus is anchored to the seabed by a plurality of mooring lines, symmetrically arranged about the platform.

U.S. Pat. No. 4,797,033 to Polack shows an anchor line-stabilized system for an articulated tower system including at least three chain devices or lines having upper ends coupled to an upper portion of the tower and lower ends anchored to the sea at locations spaced about the tower. Inclinometer means are utilized to sense tilting of the tower and to operate winch means that pull on at least one chain device extending largely opposite to the direction of tilting.

U.S. Pat. No. 4,818,146 to Fontenot provides a stabilizer for an offshore wellhead and conductor comprising an annular braced secured to the conductor, the brace including a plurality of pulleys symmetrically disposed around the brace below the surface of the water. A plurality of cables is each secured at a first end of the cable to the brace, and each of the cables is journaled around one pulley and extends outwardly and downwardly from the pulleys of the brace down to the mudline. The cable is secured at its second end to an anchor pile beneath the mudline for holding the cables in a fixed position. Similar systems incorporating an annular brace as well as a plurality of anchoring cables are shown in U.S. Pat. Nos. 4,710,061 and 4,640,647 both to Blair et al. A related system of anchoring cables but lacking an annular brace is shown in U.S. Pat. No. 5,061,131 to Petty et al.

U.S. Pat. Nos. 5,906,457, 4,378,178 to Roach, U.S. Pat. No. 3,515,084 to Holmes, U.S. Pat. No. 4,797,033 to Polack, U.S. Pat. No. 4,818,146 to Fontenot, U.S. Pat. No. 4,710,061 and U.S. Pat. No. 4,640,647 both to Blair et al., and U.S. Pat. No. 5,061,131 to Petty et al. are all hereby incorporated by reference. The prior art does not provide a solution for increasing the service life, deeper water capability, or more severe environmental capacity for existing jack-up rigs.

SUMMARY OF THE INVENTION

The present invention enables existing jack-ups to be used in deeper water locations, or in locations where the storm forces are more severe than before. This invention relates to an arrangement whereby a taut mooring system is installed on a self-elevating mobile offshore platform, commonly referred to as a "jack-up", after the hull has been elevated to an operating position above the highest anticipated wave crests. In this elevated position the hull of the jack-up is supported by trussed legs which extend vertically through openings in the hull to the ocean floor. Common jack-ups are generally triangular in plan, with a leg at each "corner" of the triangle, or each extremity of the hull. The invention extends to other configurations. The taut mooring system consists of: mooring line connections that are radially spaced in plan on the extremities or corners of the platform structure; suction pile anchors that are radially spaced around the jack-up, consistent with the radial spacing of the connection means; taut mooring lines that are radially attached between the suction piles and the connections, and a tensioning system for the mooring lines. The invention may also utilize reinforcements at the mooring line connection locations.

The present invention provides a taut mooring system that will consist of suction pile anchors, spaced radially around a jack-up, that are connected with taut mooring lines to radially spaced connections on the jack-up, that has been elevated above the sea water surface with its legs extended to the ocean floor, thereby enhancing its storm survival capabilities.

The present invention provides a taut mooring system on a jack-up that will provide resistance to some of the forces that may be applied to the jack-up by combinations of wind, wave and current, thereby increasing the severity of the environmental criteria that the jack-up is capable of resisting.

The present invention provides a taut mooring system on a jack-up, that has been elevated above the sea water surface with its legs extend to the ocean floor whereby the attached taut mooring system reduces the natural period of lateral motion of the jack-up so that the dynamic response to waves will be reduced. The reduced dynamic response will increase the environmental criteria that the jack-up is capable of resisting.

The fatigue lives of new jack-up designs will be increased by incorporating the use of a taut mooring system in the design. The taut mooring systems will reduce the natural period of lateral motions, which reduces the wave size that is likely to produce synchronous motions, resulting in fewer and lower levels of cyclic stresses which are likely to cause fatigue cracks in the critical structure of the jack-up.

The service lives of some existing jack-ups will be extended by incorporating the use of taut mooring systems to extend their fatigue lives when estimates show that the remaining fatigue lives are less than their estimated useful lives.

The safe working area of operation for existing jack-ups may be expanded by deploying a taut mooring system when it is desired to operate in areas where the anticipated magnitude of the environmental forces exceed the existing capability of the jack-up, in the unmoored condition.

The maximum operating water depth limit of existing jack-ups may be increased by the combination of lengthening the jack-ups legs and deploying a taut mooring system, when in these deeper waters. The taut mooring system will resist environmental forces to compensate for the moment increasing effects of the increased water depth. It will also reduce the natural period of harmonic motion for lateral deflections, which will compensate for the increased natural period of the unmoored jack-up, due to the increased water depth.

Incorporating the use of taut mooring systems on new jack-up designs for some of the intended areas of operation, can expand the design capabilities versus cost and increase its marketability.

New jack-ups can be designed and constructed with adequate structural strength in the hull of the jack-up to allow for the attachment of a more robust taut mooring system than may be practical as a modification to an existing jack-up. The result will be designs that are more efficient in cost versus performance than is possible with a retro-fit taut mooring system.

In embodiments of the present invention, the jack-up's elevating system can be used to tighten the mooring lines of the taut mooring system. This eliminates the need for tightening apparatus such as chain ratchets to be provided or installed. In applications where additional jacking units are provided for tensioning the taut mooring lines, the jacking units will allow for individual tautness adjustment without the need for jacking the platform on the legs. Additionally, the invention can provide a connecting means such as pin connections between the mooring jacking units and the jack-up platform so that the additional jacking capacity can be utilized to increase the variable loads when elevating the platform above the sea surface.

DETAILED DESCRIPTION OF THE PREFERRED EMBODIMENT

Figure 1:
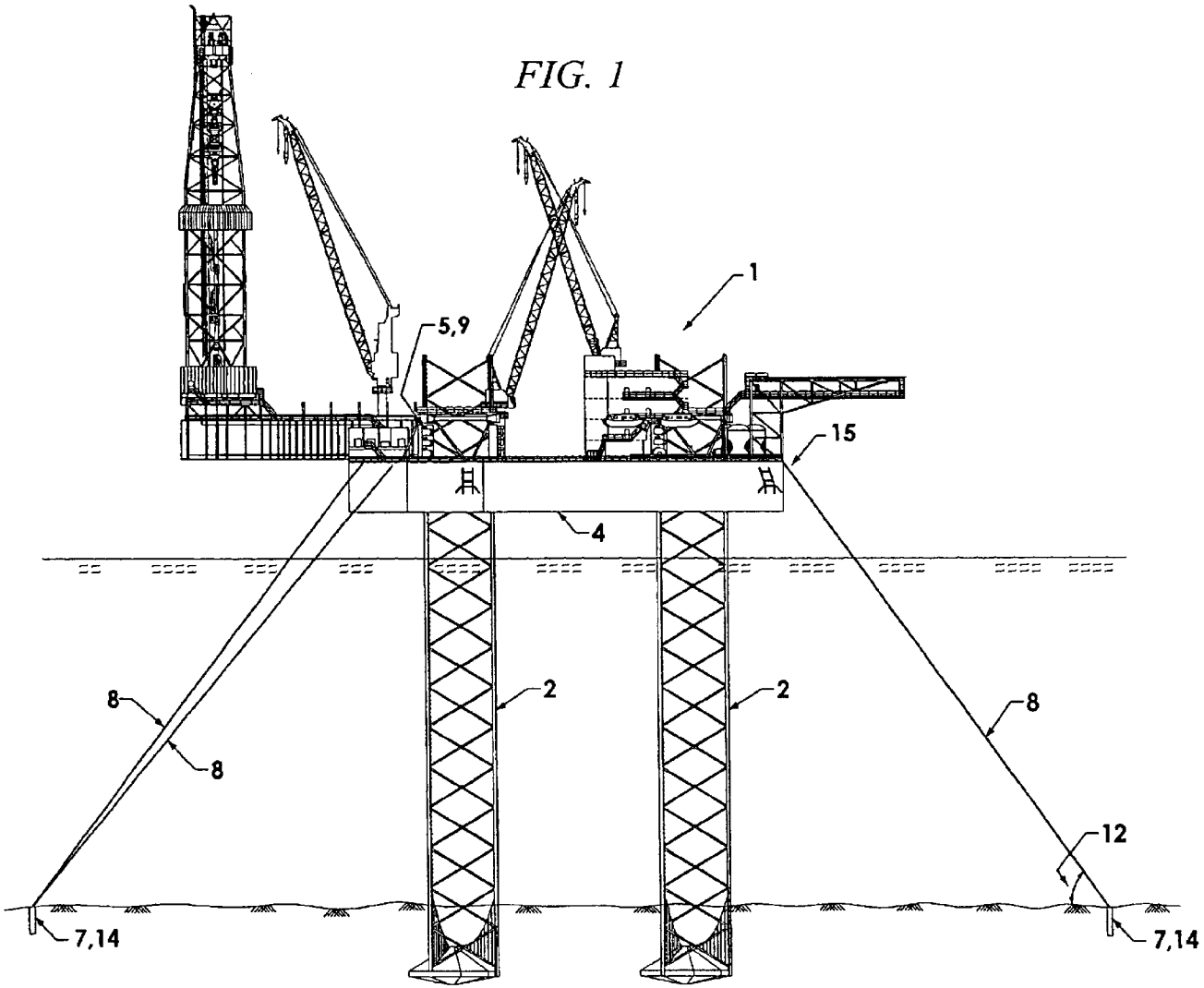
FIG. 1: is a schematic elevation view of one form of jack-up with trussed legs and taut mooring lines connected to the hull of the jack-up.

For a further understanding of the nature and objects of the present invention, reference should be had to the following detailed description, taken in conjunction with the foregoing drawings, in which like parts are given like reference numerals.

Figure 2:
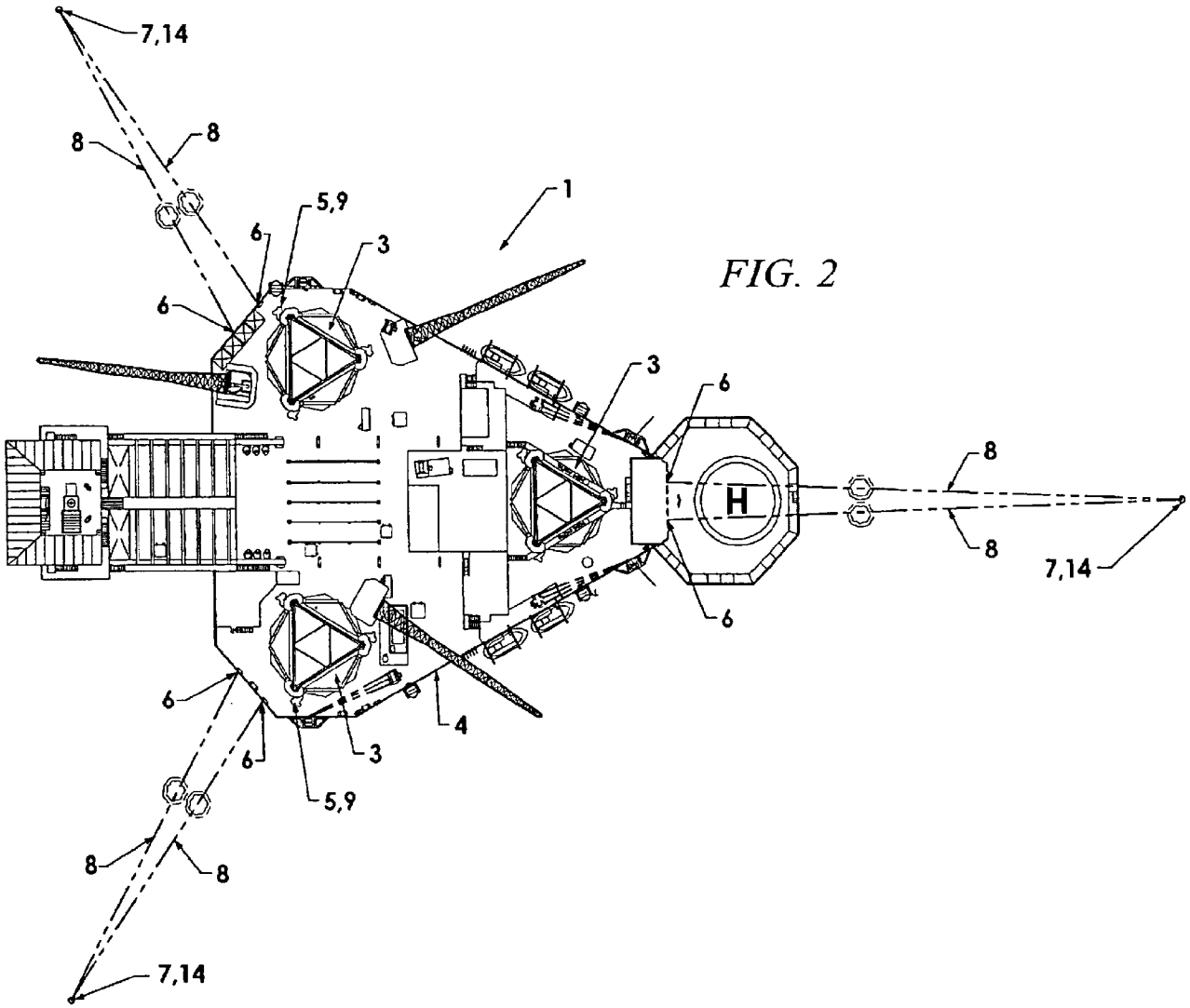
FIG. 2: is a schematic plan view of the jack-up of FIG. 1.
Figure 6:
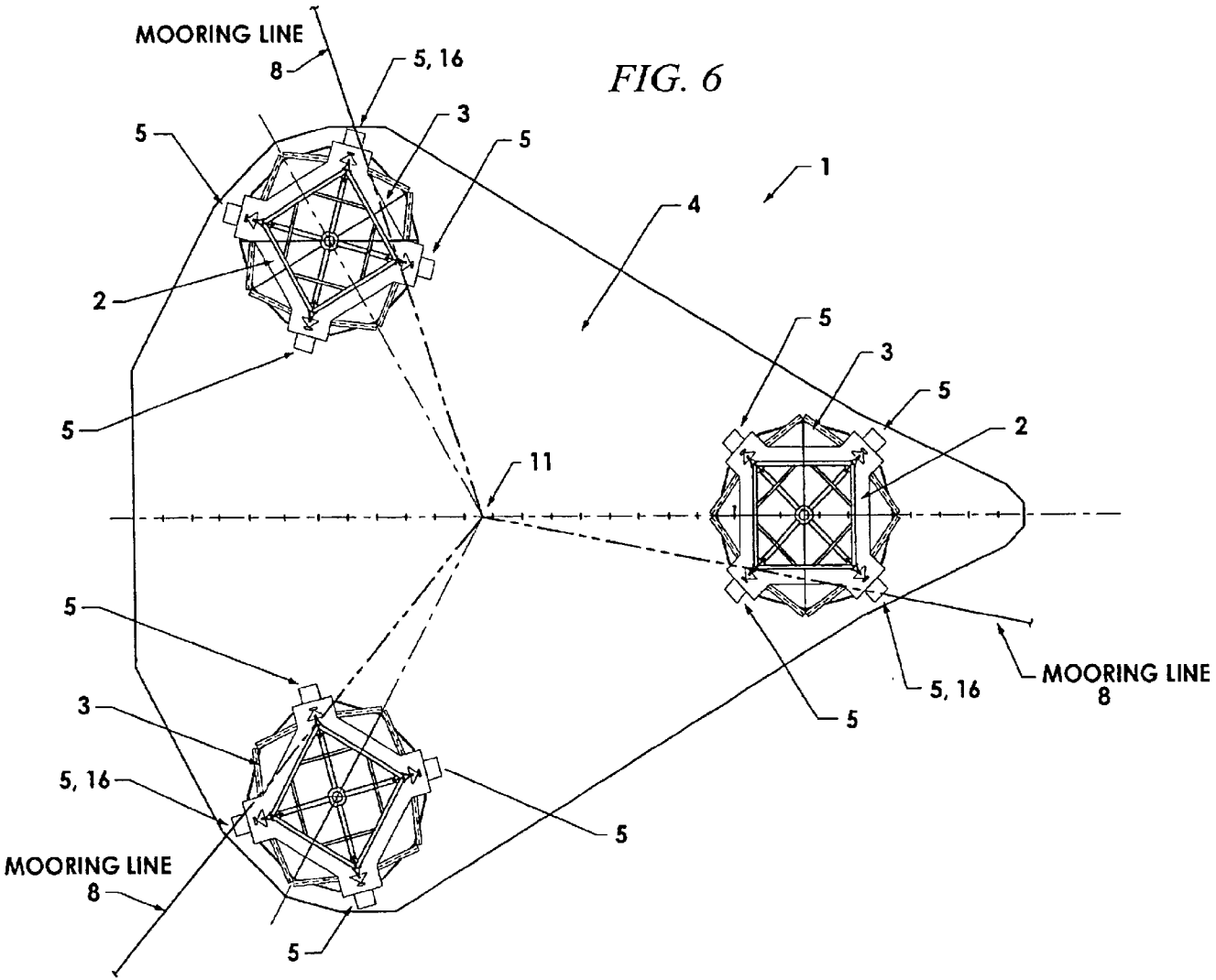
FIG. 6: is a schematic plan view of the jack-up of FIG. 5.
Figure 7:
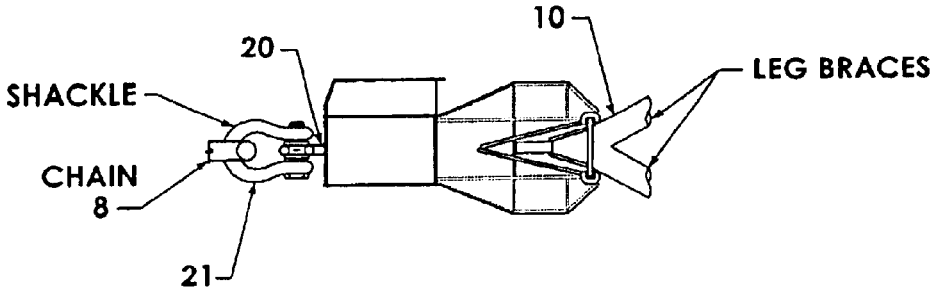
FIG. 7: is a plan view detail of the mooring line connection for a triangular leg jack-up.

FIGS. 1 and 2 illustrate, in elevation and plan respectively, one type of a self elevating mobile offshore jack-up platform 1. The platform is provided with trussed legs 2 which extend through openings 3 in the hull 4 of the jack-up rig located at the corners or extremities of the hull. Openings 3 are further provided with upper leg guides and lower leg guides Each leg 2 is provided with a mechanism or mechanisms 5 for "jacking" or for moving the leg vertically with respect to the hull of the platform. These mechanisms 5 are commonly pinion gear drives mounted to the hull working in combination with one or more gear racks fixed to each leg 2. A typical arrangement will have each leg 2 provided with one gear rack and a pinion gear drive at each corner or chord of the trussed leg. The gear racks are fixed to or formed as part of the leg chords. Trussed legs are typically either triangular in plan (FIGS. 2 and 4) or square in plan (FIG. 6).

The taut mooring system of the present invention consists of: mooring line connections 6 that are radially spaced in plan on the corners or extremities of the hull 4; anchors 7 that are radially spaced about the jack-up, consistent with the radially spacing of the connections; taut mooring lines 8 that are radially attached between the anchors 7 and the connections 6, and a tensioning system 9 for the mooring lines. See FIGS. 1 through 6.

Anchors 7 can be submerged plates, driven piles or plates, or in the primary embodiment envisioned, suction piles. Mooring lines can be cables, and/or chains, either of steel, alloy or composites. In the primary embodiment envisioned the mooring lines would be Kevlar cables.

Figure 3:
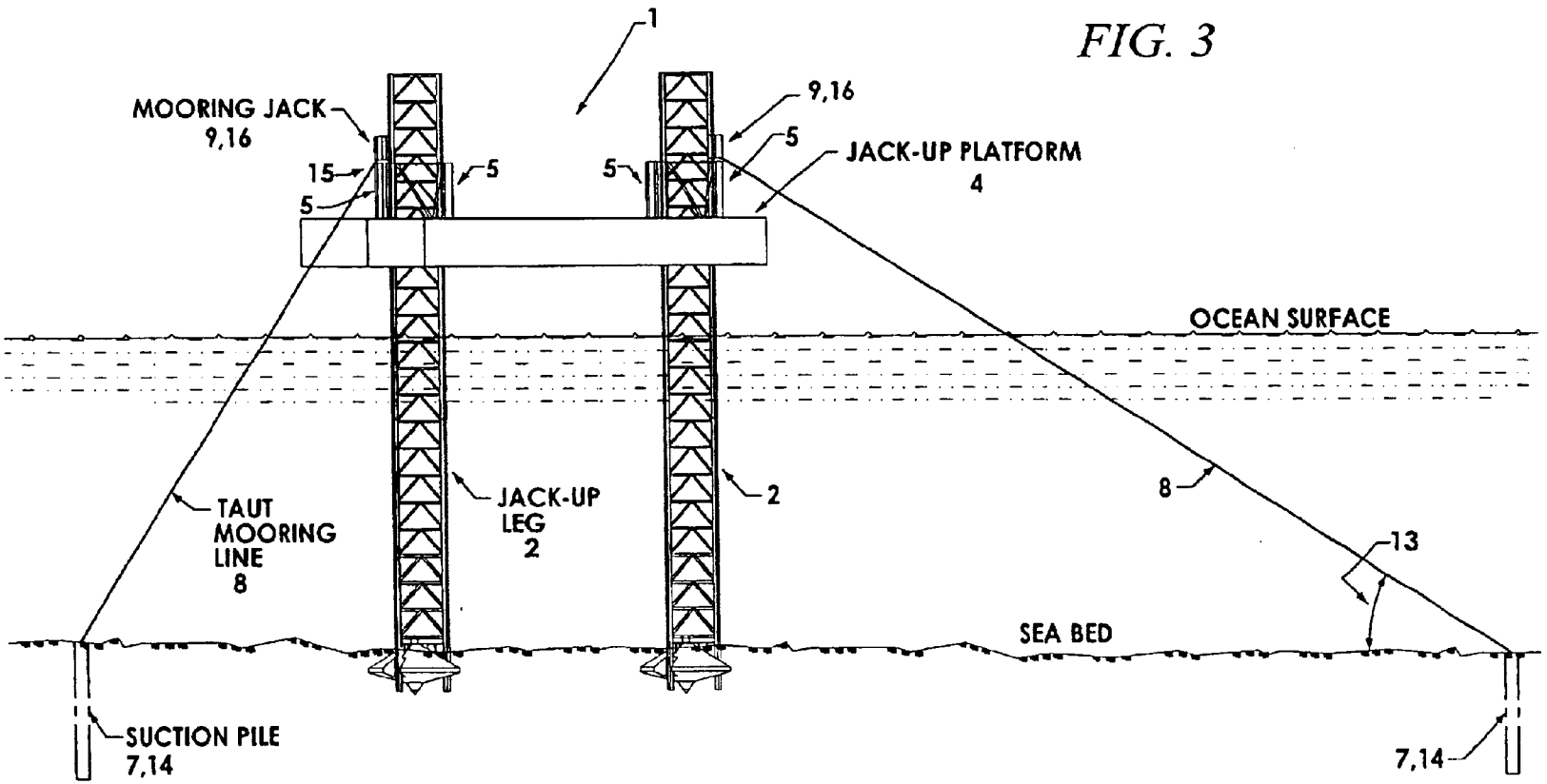
FIG. 3: is a schematic elevation view of another form of jack-up with trussed legs that are triangular in plan and taut mooring lines connected to additional jacking units.
Figure 4:
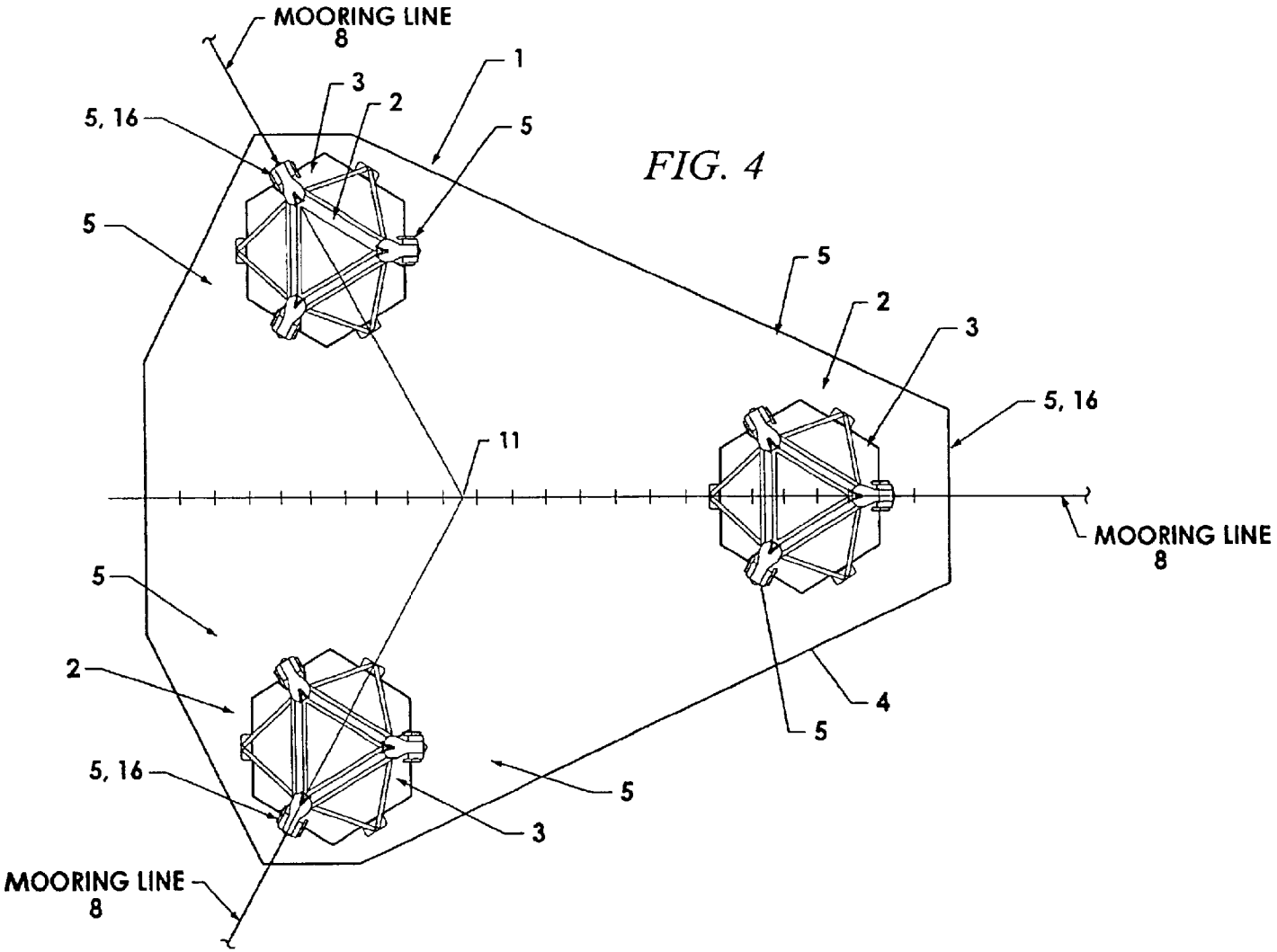
FIG. 4: is a schematic plan view of the jack-up of FIG. 3.
Figure 5:
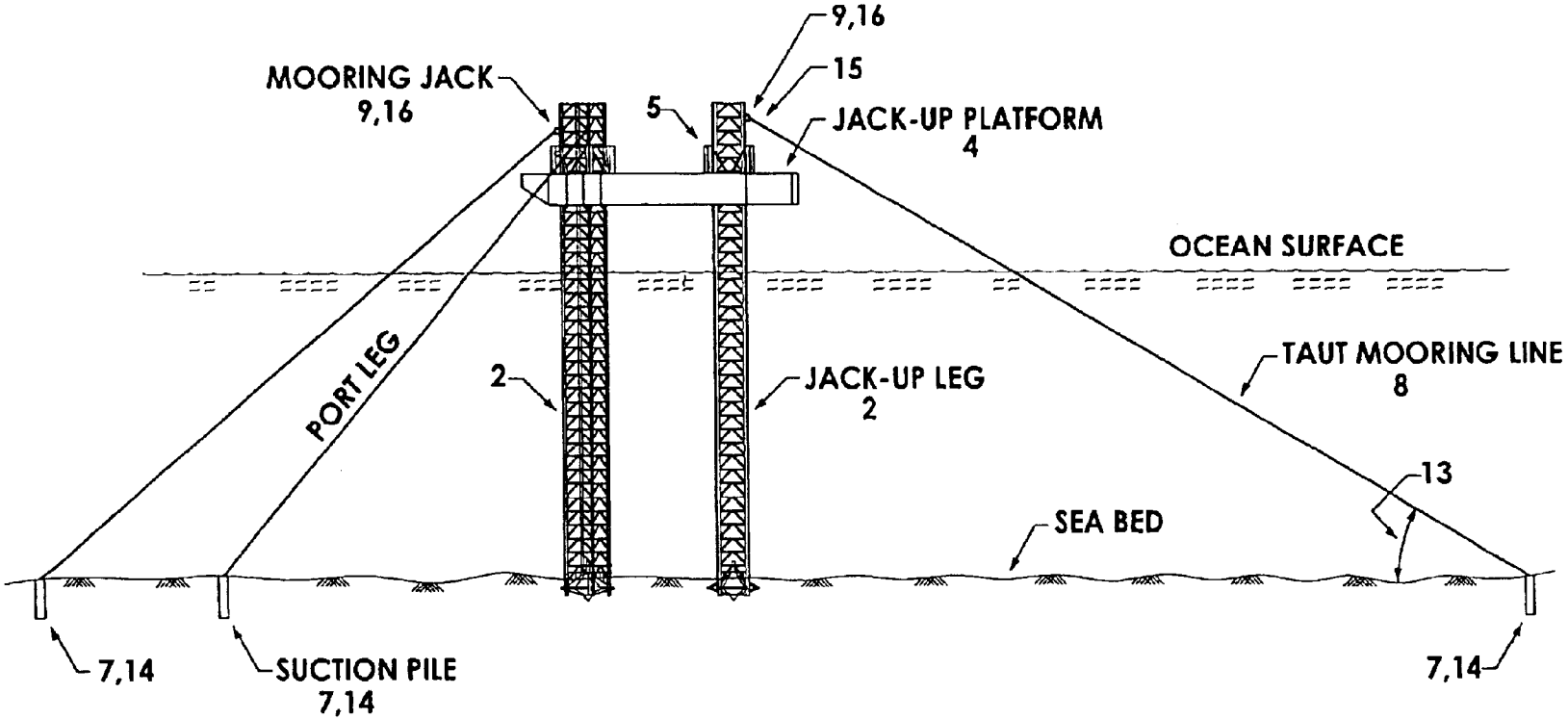
FIG. 5: is a schematic elevation view of another form of jack-up with trussed legs that are square in plan with taut mooring lines connected to additional jacking units.

Multiple cables or single cable configurations at each leg are considered equally appropriate. Symmetry of the cable orientation is desired. As shown in FIGS. 3 and 4, of the triangular leg jack-up, the mooring lines 8 extend radially from the leg corner 10, and radially from the center point of the hull 11 and radially from the center point of the leg. In contrast, as shown in FIGS. 5 and 6 for square leg designs, the mooring lines 8 extend from the leg corner 10 at an angle from a line through the leg center and the leg corner 10 so that the cable or mooring line directions are all also radially extending from the center point of the hull 11.

The present invention utilizes mooring lines 8 angled from the horizontal. FIGS. 1, 3, and 5. The angle reduces line length in comparison to conventional non-taut mooring systems commonly used on floating structures and vessels. It is desirable for the mooring line 8 to be both short and taut, if forces are to be induced into the mooring lines by storm induced lateral deflections. Long lines with significant slack absorb little force as the jack-up deflects laterally when storm forces are applied to it. Lines that are angled too steeply from the horizontal induce the higher axial load on the legs. Where lines are longer the materials and cross sections of the lines might need to be made larger in order to maintain the desired spring stiffness. Cable angles steeper than the 45 degrees (12 at FIG. 1) would induce high axial load upon the jack-up legs. Cable angles that are numerically smaller such as 20 degrees might be used. The optimum angle based upon current analysis would be 30 degrees from the horizontal. FIGS. 3 and 5, 13.

Conventional anchors work effectively when the pulling force of the mooring lines is nearly horizontal. However, the anchors can be easily pulled loose if there is a significant upwards vertical component of the line pull. The anchor system envisioned in the present invention in its primary embodiment would use suction piles 14. See FIGS. 1, 3 and 5. Suction piles are cylindrical caissons that are installed by pumping water out of the caisson, which creates a suction force that pushes the caisson into the soil. Suction piles are removed by pumping water into the caissons, which creates an expansion force that pulls them out of the soil. Suction piles are used as anchors with this invention because they have the ability to resist large vertically upward forces and because they are not only easy to install, but are also easy to remove. As a result, the same suction piles can be reused on multiple locations or alternatively, they may be rented if needed for a particular location.

When it is proposed to use a particular jack-up for operations on a specific location, a study is usually made to determine if any of the limiting design parameters will be exceeded. Some of the usual limiting design parameters are as follows:

a. Stresses in the trussed leg members
b. Storm holding capacity of the elevating pinions of the jacking system
c. Storm holding capacity of the leg-to-hull locking system, providing the jack-up is equipped with a locking system
d. Allowable leg footing reactions to the soil
e. Preload capacity
f. Overturning If a jack-up is taut moored as proposed with this invention, lateral deflections of a jack-up, caused by storm induced forces will either stretch or slacken the taut mooring lines, depending on the direction of the deflections. The stretched mooring lines will induce forces against the jack-up which will be counteractive to the forces that cause the deflections. The result will be reduced deflections that will reduce all of the limiting parameters that are outlined above. A static analysis for a jack-up that is taut moored as proposed with this invention will show that all of the usual limiting design parameters can be met for more severe environmental criteria than can be safely resisted if the jack-up were not taut moored.

In order to determine if any of these limiting design parameters will be exceeded, it is usually necessary to perform what is commonly referred to as a "static analysis". In a static analysis of a jack-up, stresses are calculated for the combination of gravity and storm induced forces. Since the wave forces applied to the jack-up fluctuate as the waves move through the structure, the wave forces used for the static analysis are usually for a phase position that applies the maximum instantaneous overturning moment to the structure.

When it is desired to use a jack-up on locations where it is likely to respond dynamically to the waves that it may encounter, a static analysis may not be adequate to evaluate the acceptability of the jack-up. For those locations it is necessary to perform what is commonly referred to as a "dynamic analysis". A dynamic analysis determines the magnitude of amplification of the structure's lateral deflections and stresses that are caused by the pulsating nature of the wave forces applied to the trussed legs. If the jack-up's natural period of harmonic motion for lateral deflections on a particular location is large enough for the structure to be resonant with a wave period that commonly exists with large waves, and if these large waves apply enough driving force against the jack-up's legs, then the dynamic amplification of the lateral motions and the resulting stresses in the critical structure may be substantially larger than the same waves would produce if the structure and the waves were not resonant. Providing there is reasonable probability that these resonant waves may occur while the jack-up is on that particular location, the structure must be able to safely withstand the stresses produced by the dynamic amplification.

If a jack-up being evaluated for a given location is planned to be taut moored as proposed with this invention, the magnitude of dynamic amplification will be less than for the same jack-up in the unmoored condition, because the restraints of the taut mooring system will cause the jack-up to have a smaller natural period for lateral motions than it would have if unmoored. The smaller natural period would cause the jack-up to be less synchronous to large waves Therefore, for conditions where dynamic response is likely, the usual limiting design parameters, as listed above, can be met for more severe environmental criteria than can be safely resisted if not taut moored.

When developing new jack-up designs, it is necessary to insure that the design will have an estimated fatigue life that is greater than the anticipated useful life of the jack-up. A jack-up's fatigue life is the estimated years of operation before fatigue cracking is likely to occur. Fatigue cracking is a phenomena that may occur when structures are subjected to cyclic loads that cause stresses to oscillate between tension and compression, at stress levels that are normally acceptable. Most jack-ups have an elevated condition natural period of harmonic motion that is less than the wave period for the jack-up's environmental design criteria. However, smaller waves with shorter periods may be synchronous with the jack-ups period and the oscillating forces from these waves may produce stress reversals that, after many synchronous wave cycles, could result in fatigue cracking of the critical structure of the jack-up. The critical structure for the likelihood of fatigue cracking to occur on most jack-ups is at the member connections at the nodes of the trussed legs.

Many factors affect the likelihood of fatigue cracking to occur during the operating life of a jack-up. Some of these factors are listed below:

a. The accumulated quantity of stress reversals in the critical structure of the jack-up, which is generally proportional to the time in the jack-up's life that is spent at or near the jack-up's maximum water depth, in areas of operation where synchronous waves are likely to occur
b. The order of magnitude of the reversing stresses, when they occur, in the critical structure of the jack-up
c. The atmospheric temperature during the time periods of the jack-up's life for which synchronous motions cause stress reversals
d. The chemical composition and manufacturing procedures used for making the steel to fabricate the critical structure of the jack-up
e. The welding consumables, procedures and quality control used for fabrication of the critical connections where cracking is likely to occur on the jack-up
f. The structural configuration of the critical connections and the resulting stress concentrations where cracking is likely to occur on the jack-up Since taut mooring will reduce a jack-up's elevated natural period for lateral motions, it will also reduce the wave size that is likely to produce synchronous motions. The obvious result of these smaller synchronous waves is lower magnitudes of cyclic stress reversals. In addition, stress reversals are less likely to occur for these smaller waves because stress reversals will not occur if the magnitude of cyclic stresses does not exceed the magnitude of the constant stresses resulting from the non cyclic loads. For these reasons, taut mooring systems as proposed with this invention may result in longer fatigue lives for new jack-up designs and existing jack-ups. Alternatively, the incorporation of taut mooring systems as proposed with this invention may allow for new jack-up designs and existing jack-ups to operate with longer legs in deeper waters and still have acceptable fatigue lives.

By logging a jack-up's history of operating water depths, environmental conditions and motion response to waves, an estimate can be made of the durations and magnitudes of stress reversals in the critical structure. With this information, a jack-up's remaining fatigue life can be estimated at any time. Due to abnormally frequent operation on locations where waves regularly produce cyclic stresses that will quickly shorten a jack-up's fatigue life, such estimates may show that some jack-ups will have a fatigue life that is shorter than had been originally estimated by the designer. For other jack-ups, the economically useful life may exceed both the originally estimated useful life and the design's fatigue life. Either situation may require a jack-up to be taken out of service before its economically useful life has expired. Alternatively, a jack-up may have its operational use restricted, such as a reduction in the maximum operating water depth, to insure that cyclic stress reversals will not occur. Restricted use usually means reduced profitability, which may shorten the remaining useful life.

If estimates indicate that a jack-up's remaining fatigue life will be less than its remaining economically useful life, the remaining fatigue life could be extended by using a taut mooring systems as proposed with this invention on locations where cyclic stress reversals are expected to occur. In most cases, the cost of using a taut mooring system as proposed with this invention would be far less than the lost revenues resulting from restricted use or shortened useful life.

As a result of adding a taut mooring system, as proposed with this invention, existing jack-ups will be able to operate safely on some locations that were previously considered unsafe, or they may be able to work year round on some locations where previously they were only allowed to work seasonally. In addition, primarily because of the natural period reducing effects of the proposed taut mooring system, some jack-ups will be able to have their legs extended and survive substantial storms in deeper water depths than they are capable of safely working in, if unmoored.

As described above in one embodiment of the present invention as shown in FIG. 1 the upper end 15 of the mooring line 8 is attached to the hull 4 of the jack-up. In this embodiment it is not necessary to have any additional apparatus for tensioning the mooring lines. The lines are affixed to the hull and tensioned by lifting the hull with the leg jacks 5. Depending upon the design conditions it may be necessary to add reinforcements to the mooring line attachment locations. The disadvantage with this method is that it may be difficult to secure the lines such that they will have equal tautness.

Future new designs may be developed with plans for attaching more robust taut mooring systems than may be practical for existing jack-ups. For the use of taut mooring systems on floating structures, it is necessary to have a means to tighten the mooring lines, such as chain ratchets. Although these tightening means may be used for tightening the mooring lines on a jack-up, they are not necessary. For a jack-up, the mooring lines could be secured to the jack-up with equal slack in each line, then the jack-up could be elevated on its legs a short distance with the jacking system, using its existing capabilities just enough to provide the desired tautness to the mooring lines. Gages or other monitors can be provided to track the tension developed in each mooring line. The disadvantage with this method is that it may be difficult to secure the lines such that they will have equal tautness.

Figure 8:
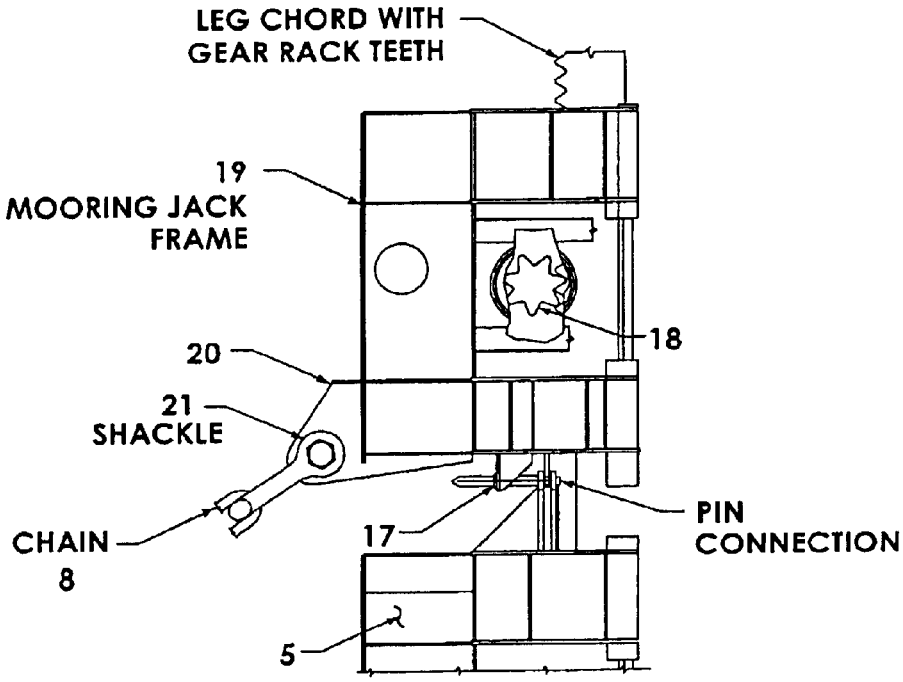
FIG. 8: is an elevational view detail of the mooring line connection and auxiliary tensioning jack unit for a triangular leg jack-up.
Figure 9:
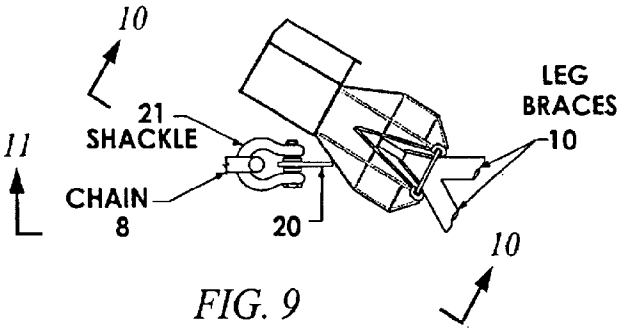
FIG. 9: is a plan view detail of the mooring line connection for a square leg jack-up.
Figure 11:
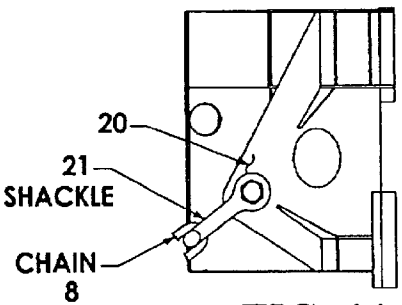
FIG. 11: is an elevation of a mooring padeye connection detail.
Figure 10:
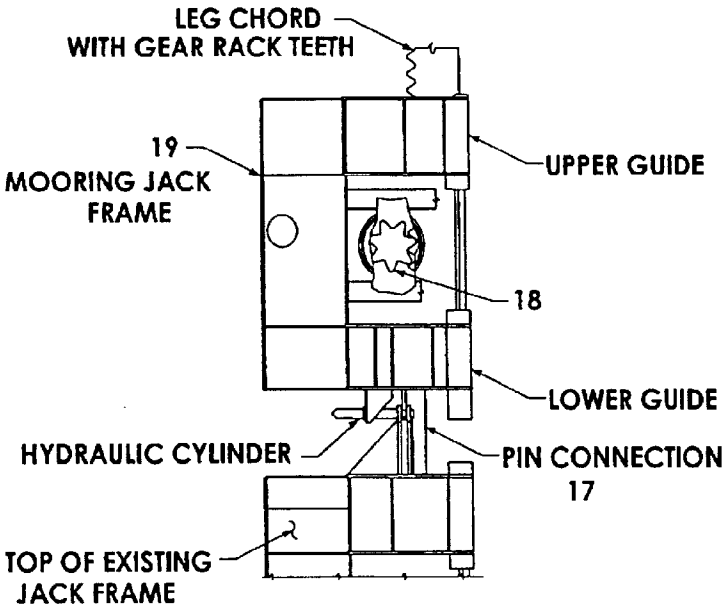
FIG. 10: is an elevational view detail of the mooring line connection and auxiliary tensioning jack unit for a square leg jack-up.

A further improvement taught by the present invention is a method and apparatus for securing the mooring lines to the jack-up is to attach the mooring lines to additional jacking units that climb leg chords that have been selected for mooring. As shown in FIGS. 8 and 10 an additional benefit of using separate jacking units 16 to secure the mooring lines 8 to the legs 2 is that these additional jacking units 16 can be connected with pins 17 or by other connections to the top of the existing jack units 5 during location moves to provide additional elevating capacity. These additional jacking units or mooring jacks 16 will be located above and could be either independent of or severable from the hull 4 and standard leg jacks 5 or otherwise linked to the hull by chains, cables or other attachments. See FIGS. 3 and 5, and see also FIGS. 8 and 10. The mooring jack units would likely be of the same design as the existing elevating gear units. It is contemplated in the present invention that the mooring jacking unit 16 would be comprised of one or more climbing pinions 18 each with gear trains and motors mounted in a frame 19 with leg cord guides above and below the gear units. Mooring lines 8 will be attached to the mooring jacks 16 by a suitable connection that will be aligned with the centroid of the leg chord to avoid applying torsion to the leg chords with the mooring forces. As shown in FIGS. 7, 8, 9, 10 and 11. Mooring pad-eyes 20 are welded onto the mooring jacks 16 or mooring jack frame 19. The mooring pad-eye 20 is provided with an apature for receiving a pinned shackle 21 for connection to the mooring line 8. As described before, the mooring line 8 can be a chain, cable or other synthetic or composite line. In the embodiment that does not use the additional or auxiliary mooring jacks 16 a similar mooring pad-eye 20 would be fixed to or mounted to the hull 4 of the jack-up. As previously described in this embodiment the standard leg jacks 5 would be utilized for tensioning and making taut the mooring lines 8.

The mooring lines would be attached to the mooring jacking units before the platform is elevated to the desired wave clearance. With the mooring jacks positioned just above the jack-up's upper guides, the mooring lines would be connected with slack such that the mooring lines would become taut when the jacking units are raised to a position that would locate them a short distance above the jack-ups upper guides after the jack-up is at the desired elevation for operations. The mooring jacking units would then be powered to climb the leg chords to tighten the mooring lines. The tautness of the mooring lines would be individually equalized by jacking each mooring jacking unit until its attached mooring line is taut. With the use of additional mooring jacks, the desired tautness could be readjusted at any time without the need for jacking the platform on the legs.

An additional benefit of using jacking units to secure the mooring lines to the legs is that these jacking units can be connected with pins or other means to the top of the existing jacking units during location moves to provide additional elevating capacity. The additional elevating capacity would result in an increase in variable loads when jacking the platform above the sea surface. This is highly desirable for existing jack-ups because most have had their variable loads reduced due to weight increases caused by modifications and machinery upgrades.

If so planned, the analysis for the new design would include taut moored conditions and the taut mooring attachment structure would be a part of the initial design.

It should be apparent that many changes may be made in the various parts of the invention without departing from the spirit and scope of the invention and the detailed embodiments are not to be considered limiting but have been shown by illustration only.

What is claimed is:

1. A taut mooring system for a jack-up platform which includes jacking mechanisms and associated legs for raising a hull of the jack-up platform above the surface of a body of water to a fixed position supported by the legs, the taut mooring system comprising mooring line connections that are radially spaced in plan on the extremities of the hull; anchors that are radially spaced around the jack-up platform consistent with the radial spacing of the connections, pre-tensioned taut mooring lines that are radially attached between the anchors and the connections, and a tensioning system for the mooring lines, whereby the mooring lines induce forces against the jack-up platform counteractive to deflective forces experienced by the jack-up platform when the hull is in the fixed position, the fixed position also being defined by the legs being engaged with a subsea surface.

2. The invention of claim 1 wherein said mooring line connections are attached to the hull of the jack-up and the tensioning system comprises the existing jacking mechanisms used to raise the hull of the jack-up above the surface of the water.

3. The invention of claim 2 wherein said jacking mechanisms comprise pinion gear drives mounted to the hull working in combination with one or more gear racks fixed to each leg.

4. The invention of claim 1 wherein said radially spaced mooring lines comprise a single line extending from each hull extremity of said jack-up, and wherein said lines are radially aligned approximately with the center point of the jack-up and disposed on approximately equal angles one from another.

5. The invention of claim 1 wherein said radially spaced mooring lines comprise multiple lines extending in sets from each hull extremity of said jack-up, and wherein said lines are symmetrically disposed in extending from each extremity of said jack-up so that the resultant forces from the combination of each set of multiple lines at each extremity are radially aligned approximately with the center point of the jack-up and disposed on approximately equal angles one from another.

6. The invention of claim 2 wherein said radially spaced mooring lines comprise multiple lines extending in sets from each hull extremity of said jack-up, and wherein said lines are symmetrically disposed in extending from each extremity of said jack-up so that the resultant forces from the combination of each set of multiple lines at each extremity are radially aligned approximately with the center point of the jack-up and disposed on approximately equal angles one from another.

7. The invention of claim 1 wherein said anchors are suction piles.

8. The invention of claim 2 wherein said anchors are suction piles.

9. The invention of claim 4 wherein said anchors are suction piles.

10. The invention of claim 5 wherein said anchors are suction piles.

11. The invention of claim 6 wherein said anchors are suction piles.

12. The invention of claim 1 wherein said mooring lines are Kevlar cables.

13. The invention of claim 2 wherein said mooring lines are Kevlar cables.

14. The invention of claim 4 wherein said mooring lines are Kevlar cables.

15. The invention of claim 5 wherein said mooring lines are Kevlar cables.

16. The invention of claim 6 wherein said mooring lines are Kevlar cables.

17. The invention of claim 1 wherein said mooring lines are connected between said anchors and said jack-up at an angle within the range of 20 degrees to 40 degrees from the horizontal.

18. The invention of claim 2 wherein said mooring lines are connected between said anchors and said jack-up at an angle within the range of 20 degrees to 40 degrees from the horizontal.

19. The invention of claim 4 wherein said mooring lines are connected between said anchors and said jack-up at an angle within the range of 20 degrees to 40 degrees from the horizontal.

20. The invention of claim 5 wherein said mooring lines are connected between said anchors and said jack-up at an angle within the range of 20 degrees to 40 degrees from the horizontal.

21. The invention of claim 6 wherein said mooring lines are connected between said anchors and said jack-up at an angle within the range of 20 degrees to 40 degrees from the horizontal.

22. The invention of claim 1 wherein said tensioning system comprises an auxiliary jacking unit for use with each leg of the jack-up and wherein said mooring line connections are attached to said auxiliary jacking units to function as the tensioning system for said mooring lines.

23. The invention of claim 22 wherein said jacking mechanisms comprise pinion gear drives mounted to the hull working in combination with one or more gear racks fixed to each leg.

24. The invention of claim 22 wherein said radially spaced mooring lines comprise a single line extending from each leg of said jack-up, and wherein said lines are approximately radially aligned with the center point of the jack-up and disposed on approximately equal angles one from another.

25. The invention of claim 22 wherein said radially spaced mooring lines comprise multiple lines extending in sets from each leg of said jack-up, and wherein said lines are symmetrically disposed in extending from each leg of said jack-up so that the resultant forces from the combination of each set of multiple lines at each leg are approximately radially aligned with the center point of the jack-up and disposed on equal angles one from another.

26. The invention of claim 22 wherein said anchors are suction piles.

27. The invention of claim 23 wherein said anchors are suction piles.

28. The invention of claim 24 wherein said anchors are suction piles.

29. The invention of claim 25 wherein said anchors are suction piles.

30. The invention of claim 22 wherein said mooring lines are Kevlar cables.

31. The invention of claim 23 wherein said mooring lines are Kevlar cables.

32. The invention of claim 24 wherein said mooring lines are Kevlar cables.

33. The invention of claim 25 wherein said mooring lines are Kevlar cables.

34. The invention of claim 22 wherein said mooring lines are connected between said anchors and said jack-up at an angle within the range of 20 degrees to 40 degrees from the horizontal.

35. The invention of claim 23 wherein said mooring lines are connected between said anchors and said jack-up at an angle within the range of 20 degrees to 40 degrees from the horizontal.

36. The invention of claim 24 wherein said mooring lines are connected between said anchors and said jack-up at an angle within the range of 20 degrees to 40 degrees from the horizontal.

37. The invention of claim 25 wherein said mooring lines are connected between said anchors and said jack-up at an angle within the range of 20 degrees to 40 degrees from the horizontal.

38. The invention of claim 22 further comprising connections for linking said auxiliary jacks to said hull wherein said auxiliary jacks can be used to increase the jacking capacity of the jack-up when elevating the hull above the surface of the body of water.

39. The invention of claim 23 further comprising connections for linking said auxiliary jacks to said hull wherein said auxiliary jacks can be used to increase the jacking capacity of the jack-up when elevating the hull above the surface.

40. The invention of claim 24 further comprising connections for linking said auxiliary jacks to said hull wherein said auxiliary jacks can be used to increase the jacking capacity of the jack-up when elevating the hull above the surface.

41. The invention of claim 25 further comprising connections for linking said auxiliary jacks to said hull wherein said auxiliary jacks can be used to increase the jacking capacity of the jack-up when elevating the hull above the surface of the body of water.

42. A jack-up platform for off-shore use, the jack-up platform having a hull movable from a first position to a second position, the jack-up platform comprising:

a plurality of jacking mechanisms;

a plurality of legs movably engaged with the plurality of jacking mechanisms, the legs and jacking mechanisms being operable for moving the hull from the first position to the second position, the first position being on a surface of a body of water and the second position being vertically spaced from the surface of the body of water, the plurality of legs being engaged with a subsea surface when the hull is in the second position to support the hull in the second position; and a plurality of mooring lines operatively secured to and extending from the hull, the mooring lines being taut and operatively engaged with a subsea surface when the hull is in the second position, whereby the plurality of mooring lines induce forces against the jack-up platform counteractive forces experienced by the jack-up platform when the hull is in the second position.

43. The jack-up platform of claim 42 wherein each of the plurality of mooring lines is operatively secured to the hull via a mooring line connection.

44. The jack-up platform of claim 42 wherein each of the plurality of mooring lines is operatively engaged with the subsea surface via an anchor.

45. The jack-up platform of claim 44 wherein the anchors are suction piles.

* * * * *